United States Patent [19]

Da Re

[11] 4,102,957

[45] Jul. 25, 1978

[54] APPARATUS AND METHOD FOR MANUFACTURING PRESTRESSED CONCRETE RAILWAY TIES

[75] Inventor: Cipriano Da Re, Laval-sur-le-Lac, Canada

[73] Assignee: Canfarge LTD (Francon Division), Montreal, Canada

[21] Appl. No.: 633,816

[22] Filed: Nov. 20, 1975

[51] Int. Cl.[2] ..... B28B 11/12; B28B 23/04

[52] U.S. Cl. ..... 264/39; 249/86; 264/157; 264/228; 264/333; 425/111

[58] Field of Search ..... 264/228, 157, 39, 82, 264/333; 425/111; 249/86

[56] References Cited

U.S. PATENT DOCUMENTS

| | | | |
|---|---|---|---|
| 2,394,227 | 2/1946 | Barber | 264/228 X |
| 2,942,321 | 6/1960 | Pinter | 264/228 X |
| 3,070,867 | 1/1963 | Belle | 264/228 X |
| 3,283,385 | 11/1966 | Oakden | 264/228 X |
| 3,577,610 | 5/1971 | Margolin | 264/228 X |
| 3,608,163 | 9/1971 | Harford | 425/111 X |
| 3,611,518 | 10/1971 | Glass | 425/111 X |
| 4,051,216 | 9/1977 | Bratchell | 264/228 X |

*Primary Examiner*—Thomas P. Pavelko

*Attorney, Agent, or Firm*—Cushman, Darby & Cushman

[57] ABSTRACT

A continuous piece of concrete is first cast in an elongated casting mould mounted on a prestressing bench; after transfer of the prestressing force to the hardened concrete, the continuous piece of concrete is cut into a series of sections, each containing a certain number of railway ties. These sections are then removed from the casting mould, placed on a roller conveyor and then brought to a second cutting station where they are cut to form individual units. The invention also concerns a novel construction of a casting mould for the specific manufacture of such tie.

7 Claims, 8 Drawing Figures

APPARATUS AND METHOD FOR MANUFACTURING PRESTRESSED CONCRETE RAILWAY TIES

FIELD OF THE INVENTION

This invention relates to an apparatus and method for manufacturing prestressed concrete railway ties and, more particularly, to the manufacture of a multiplicity of these ties without affecting the properties of each individual tie.

BACKGROUND OF THE INVENTION

The use of concrete railway ties in replacement of the standard wood ties is increasingly accepted in the construction of railways. However, the manufacture of individual prestressed concrete ties is expensive and time-consuming so that there is a need for providing a method and apparatus whereby a series of ties may be simultaneously formed for each concrete pouring operation, a method and apparatus which would also permit a high degree of mechanisation of the production processes.

An important requisite for the performance in service of a precast tie is the bond developed between the high tensile steel and the concrete; the bond must transfer the full prestressing force into the concrete as close as possible from the end of the tie to permit the presence of this force in the rail seat area. Pouring of the precast ties as a continuous piece of concrete provides the best conditions to develop the best possible bond. Furthermore because of the sawing operations, which cut the concrete as well as the wires, the end of the prestressed steel penetration from the concrete face can be measured and the anchor length of the prestressing force be computed. Each tie can also be visually inspected for the meeting of this essential requirement.

However, it is difficult to make the ties as a continuous piece of concrete due to the particular shape of a railway tie. Indeed, the monobloc concrete railway tie must include, as an integral part thereof, iron shoulders to anchor track fastening devices; therefore, the casting mould must be capable of holding these anchoring shoulders in position until the concrete is set. Secondly, the concrete railway tie must be prestressed; hence, the casting mould must be particularly constructed to allow it to move as the tension on the prestressing wires is transferred to the concrete.

STATEMENT OF THE INVENTION

The problems in the making of a multiplicity of prestressed concrete railway ties are overcome by the provision of an apparatus that includes an elongated casting mould particularly constructed to allow the securing and positioning of these iron shoulders as well as the movement of the casting mould after the transfer to the concrete of the tensioning force of the prestressing wires.

The elongated casting mould of the present apparatus is formed of a series of inter-connected individually-movable mould sections having bottom and side walls and each corresponding in shape to that of individual railway ties; each bottom wall includes a series of appropriately located openings for securing therein a series of rail anchor devices; guide means are provided for locating tie cutting means to effect a first cutting of the continuous piece of concrete into a plurality of tie sections having a given number of individual railway ties whereby the sections are subsequently removed from the mould for a second cutting of these sections into individual railway ties.

The invention also relates to a novel method of manufacturing multiple prestressed concrete railway ties, comprising the steps of:

- securing in a series of openings appropriately located in the bottom wall a longitudinal casting mould, a corresponding number of rail anchor devices;
- placing longitudinally in the mould a series of prestressing wires;
- anchoring the wires at opposite ends of the mould and introducing in the wires a predetermined prestressing force;
- pouring concrete in the mould around the anchor devices and the wires to form a continuous piece of prestressed concrete;
- curing the piece of concrete;
- transferring the prestressing force to the concrete;
- effecting a first cutting of the piece of concrete to form a plurality of tie sections, each having a given number of individual railway ties;
- removing the sections from the mould and depositing the sections on conveyor means; and
- effecting a second cutting in the sections to form a plurality of individual ties.

BRIEF DESCRIPTION OF THE DRAWINGS

Other objects, purposes and characteristic features of the present invention will be, in part, obvious from the accompanying drawings, and in part, pointed out as the description of the invention progresses. In describing the invention in details, reference will be made to the accompanying drawings, in which like reference characters designate corresponding parts throughout several views.

DESCRIPTION OF PREFERRED EMBODIMENTS

Figure 1:
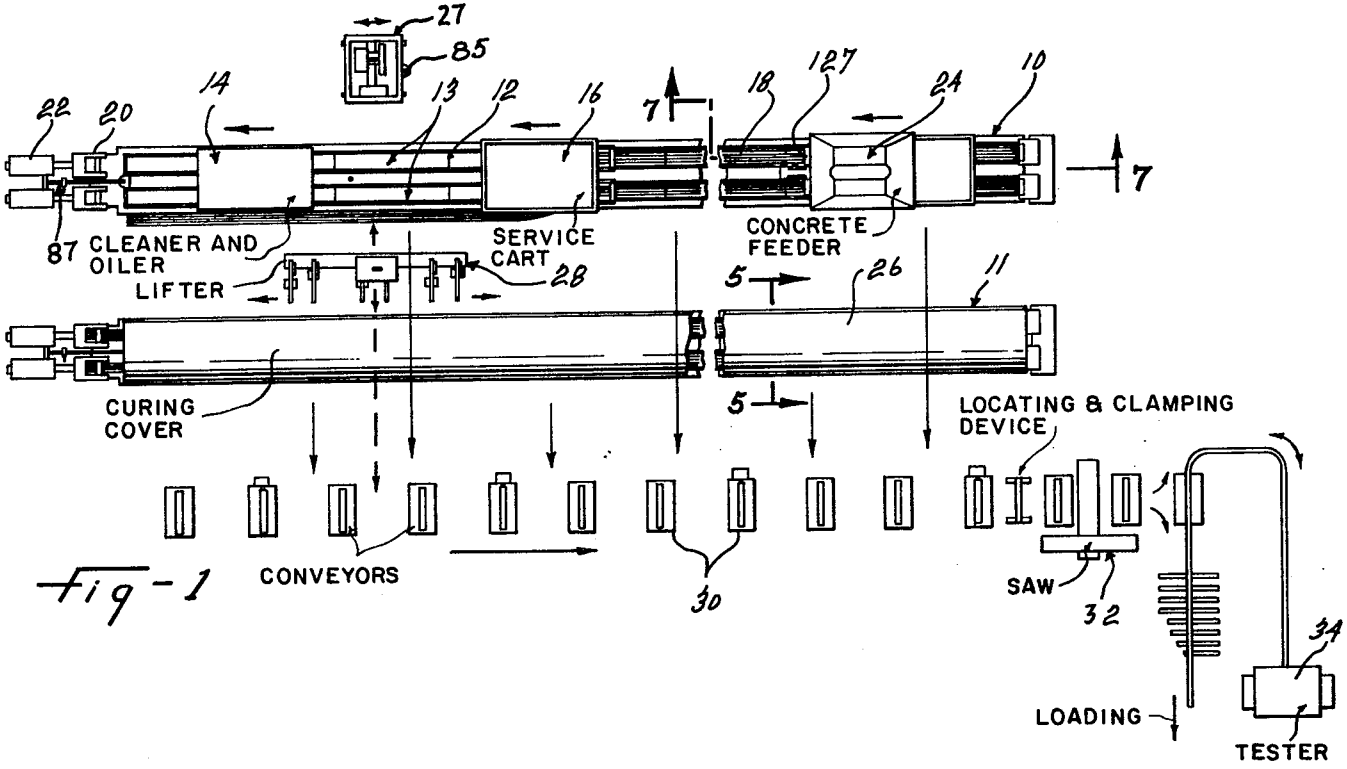
FIG. 1 is a top plan view showing a lay-out of some of the components of the apparatus used in carrying out the method of the present invention.

With reference to FIG. 1, there is shown a general lay-out of some of the components used in the carrying out of the method of the present invention.

In the embodiment illustrated, there is shown a first longitudinally extending bench 10 on which is mounted an elongated casting mould, generally denoted as 12, and including, in side-by-side arrangement two identically shaped forms 13; the number of these forms may evidently vary. In the description given hereinbelow, reference will be made to a mould even though the steps of the method described will be carried out, usually simultaneously, on both forms. Mould 12 is first cleaned and coated with a releasing agent, either manually or mechanically, with the assistance of a cart 14 which is adapted to be mounted and to roll on bench 10. A second roller cart 16 is then mounted on the bench and serves in the placing of iron shoulders and prestressing wires 18 in the casting mould. These wires are anchored to stressing heads 20 provided at each end of the casting mould and then, tensioned by means of hydraulic jacks 22. The pouring and finishing of the concrete in the longitudinal mould is performed by a self-propelled machine 24 which is also adapted to travel along bench 10. Insulated curing covers 26 are then placed over the casting mould and curing is carried out. The prestressing force in the wires is transferred to the concrete when the latter is sufficiently hardened. The continuous piece of concrete formed is cut directly in position in the casting mould by means of a longitudinally displaceable cutting device 27 to thereby form tie sections having a given number of individual railways ties. These tie sections are then picked up by a lifter 28, which is longitudinally displaceable along the bench, and are deposited on a roller conveyor 30 running parallel to the prestressing bench. The tie sections are then moved to a second cutting station 32 where, after being mechanically located and clamped, they are cut into individual railway ties. As the concrete ties move over the conveyor, before and after the second cutting operation, the ties are inspected for concrete geometry, position of rail anchor devices, position and penetration of prestressing wires from the face of the side walls of the concrete tie, and for surface appearance of concrete. At this point, the ties are handled by overhead hoist, cubed and rolled outside of the production area for yarding by a lift truck or to a tester 34 where individual ties are subjected to static loading tests at the rail seat.

In FIG. 1, a second bench 11 is illustrated to show that two longitudinally extending benches may be provided so that, during the carrying out of some of the first steps of the method, curing may be carried out on this second bench.

Figures 2, 3:
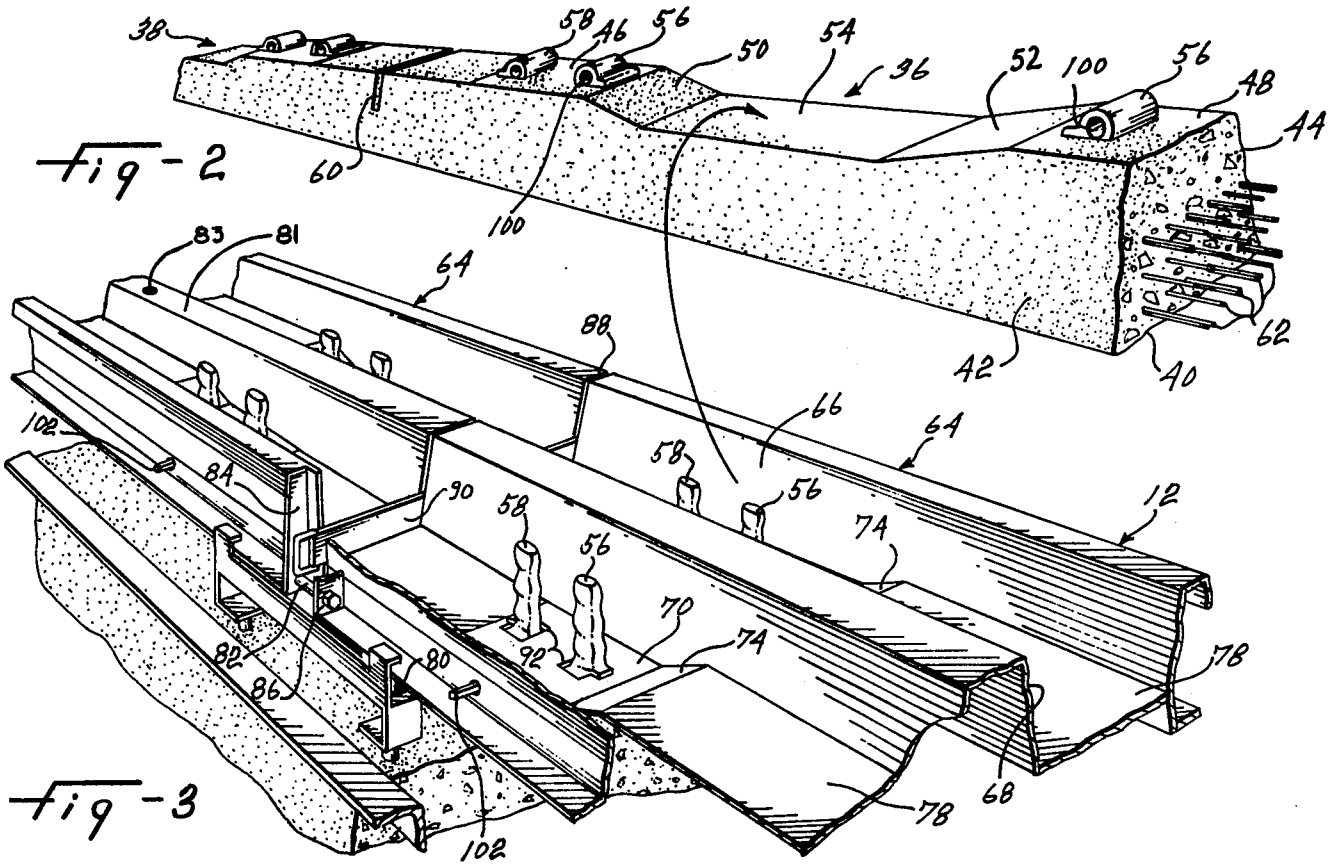
FIG. 2 is a perspective view showing a portion of one tie-containing section after a first cutting stage.
FIG. 3 is a perspective, partly broken away, view of a portion of the longitudinal casting mould.

Referring to FIG. 2 there is shown a portion of a tie section immediately after having gone through the first cutting operation and after it has been removed by lifter 28 from the casting mould 12. This tie section contains a series of individual ties (preferably five, however, only two ties 36 and 38 have been partly shown in the drawings) having a bottom face 40, opposite inclined side faces 42 and 44 and an upper face which includes two slightly inclined railway seat portions 46, 48 two further inclined faces 50 and 52 and one flat central portion 54. Each seat portion includes a pair of malleable iron shoulders 56 and 58 which are integrally cast with the tie, as described hereinbelow. These shoulders serve to anchor rail fastening devices, such as rubber bearing pads, nylon lined steel clips (providing track gage control between the shoulders and electrical insulation), and spring steel anchors which are inserted in and over the shoulder to secure the rail to the tie; these rail fastening devices have not been shown since they are not part of the present invention. Between ties 36 and 38 illustrated in FIG. 2, a slit 60 is provided and its function and mode of making will hereinafter be described.

A series of prestressing wires 62 (or strands) are embedded in the railway tie and their arrangement and number are determined by the specific use of the railway tie and are not, as such, part of the present invention.

Referring to FIG. 3, casting mould 12 is formed of a series of contiguous interconnected mould sections 64, each including faces 66, 68, 70, 72, 74, 76 and 78 corresponding in shape to faces 42, 44, 46, 48, 50, 52 and 54, respectively, of the concrete tie 36. These mould sections are mounted for movement on rollers 80 over bench 10 and are appropriately attached lengthwise by suitable joint means, such as bolts 82, interconnecting adjacent flanges 84 and 86 of two adjacent mould sections 64. A transverse gap forming a slot 88 is left between two adjacent mould sections; a separator plate 90 is received in the lower portion of this slot, and rests on the bottom wall of the casting mould. The separator plates 90 will form slits 60 in the concrete which serve to reduce concrete area for both first and second cutting operations. Since the first cutting operation is carried out when the piece of concrete is still in the casting mould, it may be preferable to have the width of the slots used in connection with the first cutting operation, slightly larger than the other slots so as to allow suitable access for the cutting saw 27. The positioning of the cutting saw 27 relative to the casting mould 12 is carried out by means of guiding holes 83 in the central protruding portion 81 of the mould; locking pin means (not shown) extend through holes 83 when in registry with holes 85 of the cutting saw means 27.

The purpose of slots 88 is to allow, once the prestressing force in the wires is transferred to the concrete, a certain movement of the mould section 64 as a result of the slight longitudinal contraction of the concrete. The absence of such slots would cause deformation of and damage to the casting mould once the prestressing force is released at opposite ends of the casting mould. This movement of the casting mould is assisted by the supporting rollers 80 situated therebeneath. After the tie sections are removed from the casting mould, it is necessary to stretch the casting moulds to regain their original casting position. This is accomplished by tensioning devices 87, shown at one end of bench 10 in FIG. 1. The stretching of the mould sections is carried out until the heads of bolts 82 abut against their corresponding mould flanges 86.

Figure 4:
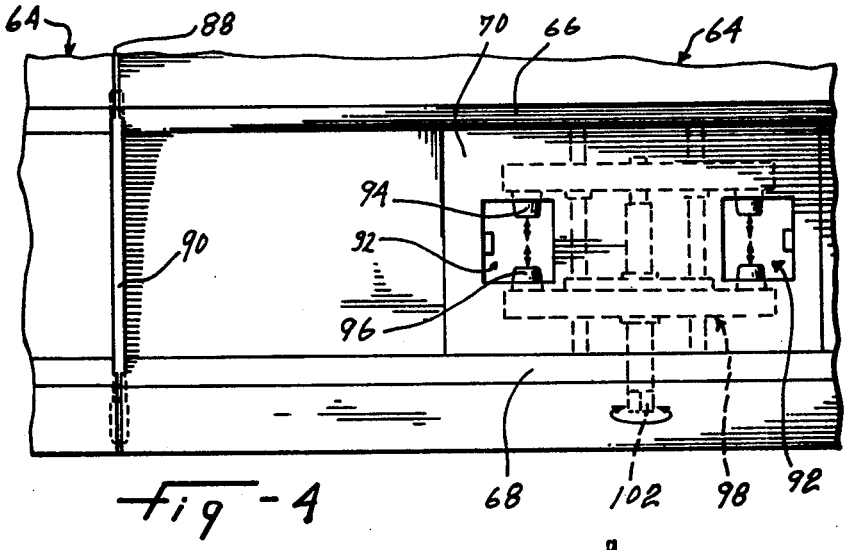
FIG. 4 is a top plan view showing a portion of the longitudinal casting mould with the means for securing the anchor devices in position.

Each mould 64 includes in its bottom wall four openings 92 to receive the head portion of the rail anchor devices 56 and 58. Referring to FIG. 4, these anchor devices are secured in openings 92 by means of two movable lugs 94 and 96 of a locking mechanism, generally denoted 98, the lugs fitting into bore 100 of the anchor heads. A locking rod 102 extends outside the casting mould side wall to allow movement of locking lugs 94 and 96 in and out of bore 100.

Figure 5:
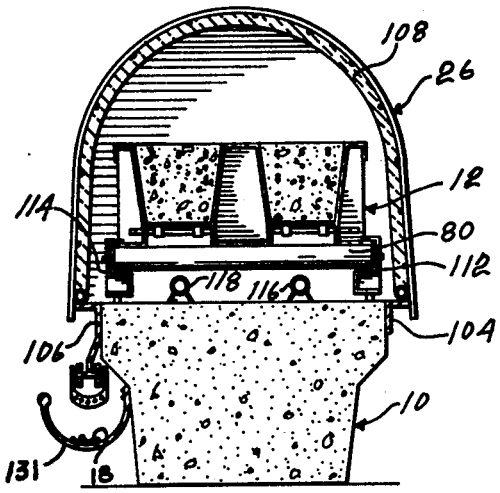
FIG. 5 is a cross-sectional view taken along lines 5—5 of FIG. 1.

FIG. 5 shows the working bench 10 on which is mounted the casting mould 12. The working bench 10 includes on opposite sides thereof a pair of flanges 104 and 106 acting as rails on which the various carts are adapted to roll and as support for a curing frame 108. This frame is covered with curing covers 26 prefabricated in short section and preferably insulated. The casting mould 12, as indicated above, is mounted on rollers 80 and is spaced from the upper surface of the working bench 10 by means of spacing elements 112 and 114 so as to allow the running of two steam lines 116 and 118.

Figure 6:
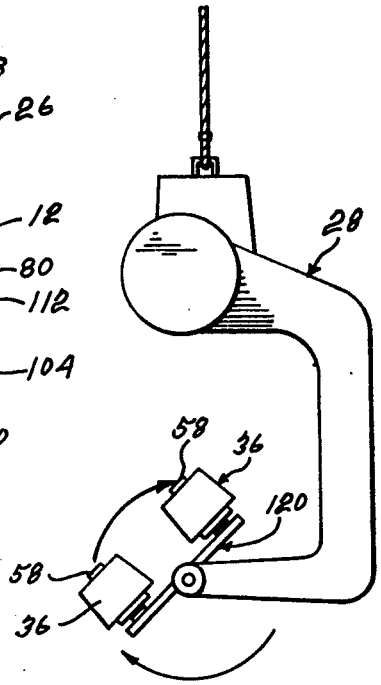
FIG. 6 is an elevational view of a lifting device used in the present invention.

Referring to FIG. 6, lifter 28 is a overhead suspended device which includes, at one end thereof, pivotable air suction means 120 which become fixedly attached to the tie sections to remove them from the casting mould and rotate them 180° whereby they are subsequently deposited on roller conveyors 30 (see FIG. 1).

Figure 7:
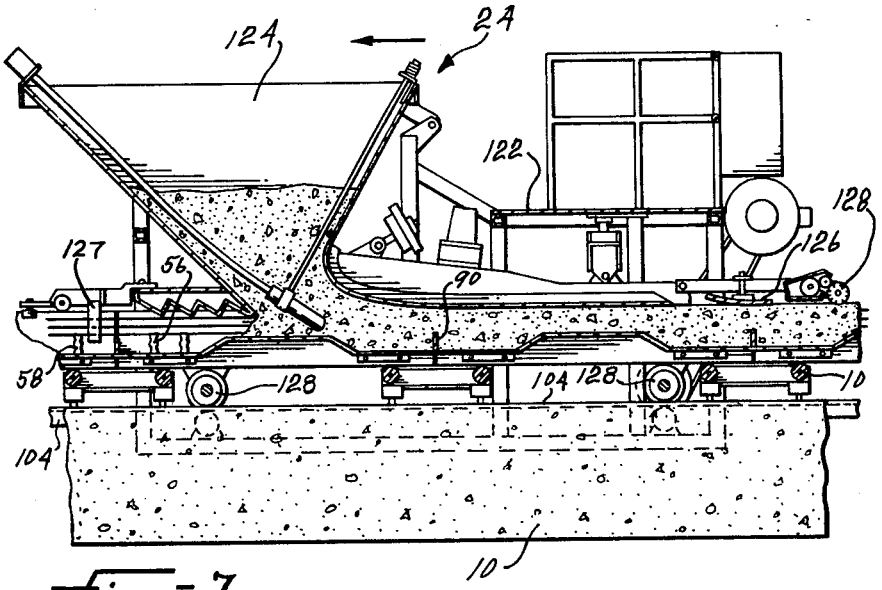
FIG. 7 is an elevation cross-sectional view showing the concrete pouring cart in operation on the working bench.

Referring to FIG. 7, the concrete feeder 24 is mounted on rollers 128 so that it may longitudinally travel on the opposite rail flanges 104 and 106 of the working bench 10. The cart is self-propelled and includes a platform 122 for the operator. It also includes a hopper 124 in which are mounted internal vibrator means 126 to assist in the dispensing of concrete in the casting mould. The machine further includes external vibrator means (not shown) and a trowelling plate 126 to finish off the bottom face of the tie being cast. A cylindrical roller 128 having a series of small projecting heads is also mounted at the rear to form small cavities in the upper face of the piece of concrete to provide better friction in service between the tie and the ballast. At the opposite end of the feeder, a pair (for each casting form) of wire supporting and positioning devices 127 are mounted and serve to accurately position the wires, which were pre-cut and stored in the bench side trough 131 (see FIG. 5), in the casting moulds just prior to concrete feeding.

Figure 8:
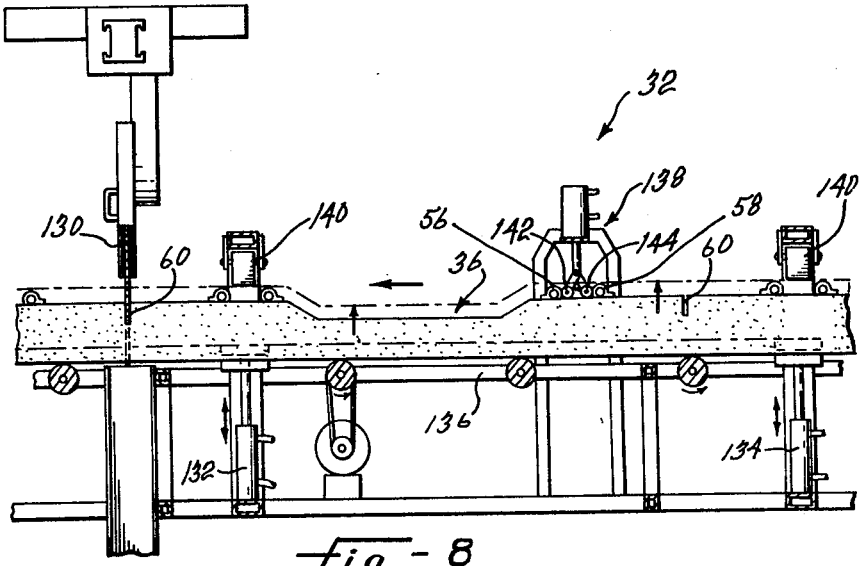
FIG. 8 is an elevational view showing the clamping devices at the second cutting station.

Referring to FIG. 8, the second cutting station 32 is shown where sections of railway ties are cut into individual units. In order to fixedly secure tie section 36 for the second cutting operation, there is provided a clamping device that includes air jack means 132 and which lifts section 36 off the roller conveyor 136 and pushes it against stoppers 140 (as illustrated by the dotted lines). To accurately position this tie section 36 relative to the saw 130, device 138, which is fixed relative to saw 130, includes two spring-biased arms 142 and 144 which bear against the inside faces of the two shoulder heads 56 and 58 respectively. When it is fixedly secured and positioned, the saw is aligned with slits 60 which, as explained above, were formed by the separator plates 90 to produce a reduction in the cutting operation.

To recapitulate a brief description of one preferred form of carrying out the method of the present invention will now be given. First, the casting mould 12 is stretched to provide the desired spacing 88 between each mould section 64. Then, the casting mould 12 is cleaned and oiled. Dividing plates 90 are placed at their proper location in spacings 88. The prestressing steel wires 18 are cut to length and placed in trough 131 adjacent the bench 10. The rail anchor devices 56, 58 are placed in the casting mould together with the wires 18. The anchor devices are secured in place in their proper openings by operating locking rod 102 in each mould section. The wires are anchored at head 20 and tensioned by means of hydraulic jacks 22. The concrete is then poured in the casting mould, the device 127 ensuring the exact positioning of the wires. The concrete is then covered and cured. After a predetermined time interval, tension on the mould is released and the prestressing force in the wires is transferred to the concrete by releasing jacks 22. The mould is then uncovered and a first cutting operation of concrete and wires is carried out directly in the casting mould to produce sections of multiple ties. The next step consists in stripping these sections, turning them upside down by means of lifter 28 and positioning them on top of roller conveyors 30. Then, the sections are moved to a second cutting station 32 where they are cut into individual ties. The following steps may consist in inspecting and testing the ties. The individual ties are then cubed and rolled outside the plant for yarding.

What is claimed is:

1. A method of manufacturing multiple prestressed concrete railway ties with a longitudinal casting mold which is formed of a series of interconnected, individually movable mold sections, comprising the steps of:

(a) exerting a pull at opposite ends of the casting mold to provide a gap to a predetermined extent between each of said interconnected movable mold sections, (b) securing in a series of openings appropriately located in the bottom wall of said longitudinal casting mold, a corresponding number of rail anchor devices, (c) placing longitudinally in said mold a series of prestressing wires, (d) anchoring said wires at opposite ends of said mold and exerting on said wires a predetermined prestressing force, (e) pouring concrete in said mold around said anchor devices and said wires to form a continuous piece of prestressed concrete, (f) curing said piece of concrete, (g) transferring said prestressing force to said piece of concrete whereby movement of the mold sections tending to close said gap is permitted, (h) effecting a first cutting of said piece of concrete to form a plurality of sections, each section having a given number of individual railway ties, (i) removing said sections from said mold and depositing said sections on conveyor means, and (j) effecting a second cutting in said sections to provide a plurality of individual railway ties.

2. A method as defined in claim 1, cleaning said casting mould and coating said mould with a releasing agent prior to said anchor positioning step.

3. A method as defined in claim 1, vibrating said concrete while pouring.

4. A method as defined in claim 1, wherein said curing is carried out by covering said mould with a dome-like covered frame and by circulating steam from running steam-lines located under said mould.

5. A method as defined in claim 1, wherein two parallel casting moulds are provided in side-by-side arrangement and wherein said steps are simultaneously carried out on both moulds.

6. A method as defined in claim 1, mechanically locating and clamping said sections prior to said second cutting step.

7. A method as defined in claim 1, placing in said gap extending between said mould sections, prior to said anchor positioning step, a series of separator plates for reducing cutting area in said concrete piece; removing said plates during said curing step.

* * * * *